United States Patent [19]

Leonard et al.

[11] Patent Number: 4,929,414

[45] Date of Patent: May 29, 1990

[54] METHOD OF MANUFACTURING HEAT PIPE WICKS AND ARTERIES

[75] Inventors: John F. Leonard; Jerry E. Beam, both of Beavercreek, Ohio

[73] Assignee: The United States of America as represented by the Secretary of the Air Force, Washington, D.C.

[21] Appl. No.: 261,807

[22] Filed: Oct. 24, 1988

[51] Int. Cl.[5] ..... B22F 3/00

[52] U.S. Cl. ..... 419/2; 29/527.2; 29/890.032; 165/104.27; 419/8; 419/36; 419/40

[58] Field of Search ..... 29/157.3 H, 157.3 R, 29/527.1, 527.2; 419/2, 8, 36, 40; 427/231, 239; 165/104.26, 104.27

[56] References Cited

U.S. PATENT DOCUMENTS

| | | | |
|---|---|---|---|
| 3,666,005 | 5/1972 | Moore, Jr. | 165/105 |
| 3,681,843 | 8/1972 | Arcella et al. | 29/423 |
| 3,762,011 | 10/1973 | Staudhammer et al. | 29/167.3 R |
| 3,840,069 | 10/1974 | Fischer et al. | 165/105 |
| 3,911,547 | 10/1975 | Vinz | 29/157.3 R |
| 3,913,664 | 10/1975 | Roukis et al. | 29/157.3 H |
| 4,039,703 | 8/1977 | Kamijo et al. | 427/231 |
| 4,196,504 | 4/1980 | Eastman | 29/157.3 R |
| 4,274,479 | 6/1981 | Eastman | 165/104.26 |
| 4,305,756 | 12/1981 | Wiech, Jr. | 419/36 |
| 4,404,166 | 9/1983 | Wiech, Jr. | 419/36 |
| 4,461,343 | 7/1984 | Token et al. | 165/104.26 |
| 4,565,243 | 1/1986 | Ernst et al. | 165/104.26 |
| 4,760,878 | 8/1988 | Fukui et al. | 427/239 X |
| 4,765,950 | 8/1988 | Johnson | 419/2 |

FOREIGN PATENT DOCUMENTS

| | | | |
|---|---|---|---|
| 553299 | 2/1958 | Canada | 419/2 |
| 51-11006 | 1/1976 | Japan | 29/157.3 H |

*Primary Examiner*—Howard N. Goldberg
*Assistant Examiner*—I. Cuda
*Attorney, Agent, or Firm*—Fredric L. Singer; Donald J. Singer

[57] ABSTRACT

A new method for making a heat pipe wick and arteries includes drilling. Radial holes around the circumference of the heat pipe container at its ends and stringing monofilament polymer lines inside the container between corresponding holes. The container is rotated at a slow rate while a slurry of nickel powder mixed into a viscous binder of water, Polyox and Methocel is injected inside the container to cover the inside surface of the container and the lines. The rotational rate of the container is then increased to force the slurry to level out to an uniform depth set by the thickness of sleeves attached at each end of the container. Forced air is blown through the inside of the rotating pipe to dry the slurry and form a green wick. After stopping rotation of the pipe, it is then heated inside a sintering oven in a reducing atmosphere to disintegrate the binder and polymer lines and to leave a sintered metal wick having hollow longitudinal arteries.

5 Claims, 1 Drawing Sheet

METHOD OF MANUFACTURING HEAT PIPE WICKS AND ARTERIES

RIGHTS OF THE GOVERNMENT

The invention described herein may be manufactured and used by or for the Government of the United States for all governmental purposes without the payment of any royalty.

CROSS-REFERENCE TO RELATED APPLICATIONS

This application relates to five companion applications titled: A METHOD OF MANUFACTURING HEAT PIPE WICKS, U.S. application Ser. No. 07/261,809; UNIDIRECTIONAL HEAT PIPE AND WICK, U.S. application Ser. No. 07/261,808; ELECTRICAL BATTERY CELL WICKING STRUCTURE AND METHOD, U.S. application Ser. No. 07/261,804; RIGIDIZED POROUS MATERIAL AND METHOD, U.S. application Ser. No. 07/261,803; and ALKALI AND HALOGEN RECHARGEABLE CELL WITH REACTANT RECOMBINATION, U.S. application Ser. No. 07/261,802, all filed on same date as this application and hereby incorporated by reference as if fully rewritten herein. Some of the applications have different named inventors and all of the applications are subject to an obligation of assignment to the Government of the United States as represented by the Secretary of the Air Force.

BACKGROUND OF THE INVENTION

This invention relates generally to heat pipes, and more specifically to methods for making sintered metal heat pipe wicks with arteries.

Heat pipes use successive evaporation and condensation of a working fluid to transport thermal energy, or heat, from a heat source to a heat sink. Because most fluids have a high heat of vaporization, heat pipes can transport in a vaporized working fluid very large amounts of heat. Further, the heat can be transported over very small temperature differences between the heat source and heat sink. Heat pipes generally use capillary forces through a porous wick to return condensed working fluid, or condensate, from a heat pipe condenser section (where transported thermal energy is given up at the heat sink) to an evaporator section (where the thermal energy to be transported is absorbed from the heat source).

Heat pipe wicks are made by a variety of different methods. The most common method is by wrapping metal screening or felt metal around a cylindrically shaped mandrel, inserting the mandrel and wick inside a heat pipe container and then removing the mandrel. Another method produces a heat pipe wick of sintered metal. Sintered metal wicks are generally made by filling powered metal into the space between a mandrel and the inside surface of a heat pipe container and then heating the powder to sinter together the individual particles and make a porous wick. The mandrel, having been previously surface treated to aid separation, is then removed from inside the sintered wick. Sintered metal heat pipe wicks may also be made, as taught in companion application Ser. No. 07/261,809, by coating the inside of a spinning heat pipe container with a slurry of metal powder mixed into a viscous binder drying the spinning wick to form a green wick, then stopping the container and wick and heat treating the wick to disintegrate the binder and leave a sintered metal wick. This new method of making sintered metal heat pipe wicks, referred to hereinafter as the spinning pipe method, produces higher performance wick than has been known before in the art.

Prior art heat pipe wicks, whether wrapped, sintered or made by other methods, are generally greatly improved by the addition of longitudinal channels or arteries. The channels or arteries may be either entirely within the wicks or on the inside surface of the heat pipe container in contact with the wick material. While the small pore size of most wick material provides high capillary pumping forces, the resulting convoluted passages for the flow of liquid cause a viscous drag which reduces the total fluid flow. The addition of relatively straight open channels or arteries provides a low loss path for the flow of large amounts of liquid working fluid pumped by the small pores of the porous wick material.

The prior art teaches a variety of methods for producing such channels or arteries. One method is to build the wick around a series of rods or tubes and then pull out the rods or tubes to leave arteries through the wick. Alternately, appropriate etchants have been used to dissolve the rods or tubes and leave arteries through the wick.

While these methods for making arteries through wicks may possibly be adapted for use with the spinning pipe method, adapting them will be awkward and cumbersome. Also, when using these methods, it is often difficult to accurately position the arteries and arteries are not perfectly formed or sized.

Thus it is seen that there is a need for a method for making arteries through wicks made by the spinning pipe method that is neither unwieldy nor complicatedm, but simple and direct, and which produces accurately positioned, sized and shaped arteries.

It is, therefore a principal object of the present invention to provide a method for making arteries in heat pipe wicks made by the spinning pipe method that is uncomplicated and straightforward, and which produces extraordinarily accurately sized, shaped and positioned arteries.

It is an advantage of the invention that it easily makes arteries of varied sizes and shapes.

SUMMARY OF THE INVENTION

In accordance with the foregoing principles and objects of the present invention, a novel method of making heat pipe wicks with arteries is described which combines the excellent properties of a heat pipe wick made by the spinning pipe method with the advantages of arteries. The unique discovery of the present invention is that monofilament polymer line can be very accurately positioned near or next to the inside Walls of a heat pipe container, then have a sintered metal heat pipe wick formed around it according to the teachings of the spinning pipe method, and that the monofilament polymers will have vaporized at temperatures below the sintering temperature leaving accurately sized, shaped and positioned arteries. The vaporization leaves only a small amount of an easily cleaned carbon residue.

Accordingly, the invention is directed to a method for making arteries inside a heat pipe wick, comprising the steps of securing at least one line at a preselected position generally within a volume to be occupied by the wick, fabricating the wick so that it covers the secured line and then heating the wick to a temperature above the decomposition temperature of the line so that the line disintegrates leaving in its place an artery through the wick. The lines may be made of a monofilament polymer.

The invention also includes a method for making a heat pipe wick with arteries on an inside surface of a heat pipe container, comprising the steps of securing lines at preselected positions, providing a slurry of metal particles suspended in a viscous binder, coating at least part of the inside surface of the container with the slurry, rotating the container so that the slurry generally covers the inside surface of the container and the lines, while continuing to rotate the container, drying the slurry to form a green wick and, after stopping rotation of the container, heat treating the green wick to yield a final composition of the heat pipe wick, wherein the heat treating includes temperatures above at least the decomposition temperature of the lines so that the lines disintegrate leaving in their place arteries through the wick. The heat treating may include heating the green wick in a reducing gas atmosphere held above the decomposition temperature of the viscous binder and below the melting point of the metal particles to yield a sintered metal heat pipe wick. The metal particles may be made from a metal selected from the group consisting of nickel, copper, molydenum, aluminum and their alloys.

BRIEF DESCRIPTION OF THE DRAWINGS

The present invention will be more clearly understood from a reading of the following detailed description in conjunction with the accompanying drawings wherein.

DETAILED DESCRIPTION OF THE INVENTION

Figure 1:
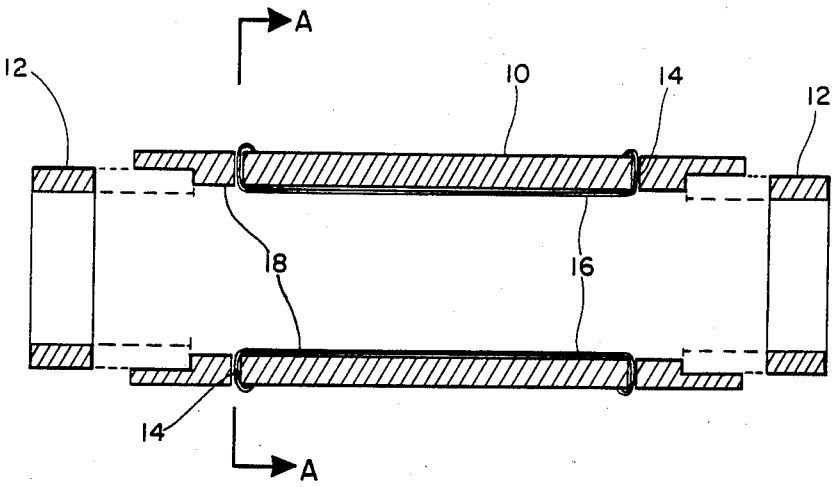
FIG. 1 is a longitudinal cross-sectional view of a heat pipe container having a rtery-forming monofilament polymer lines installed according to the teachings of the invention.
Figure 2:
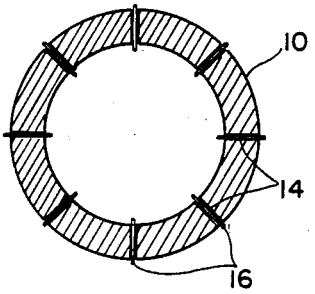
FIG. 2 is a cross-sectional view of the heat pipe container of FIG. 1 taken along the lines A—A; and, FIG. 3 is a cross-sectional view of a heat pipe container and wick showing arteries through the wick made according to the teachings of the invention.

Referring now to FIG. 1, there is shown a longitudinal cross-sectional view of a heat pipe container 10. Heat pipe container 10 is shown shorter than is typical to show all elements in one figure. A pair of sleeve inserts 12, shown separated from container 10 for clarity, fit into the ends of container 10. Eight small radially directed holes 14, in this embodiment 0.027 inch diameter, are drilled around the circumference of container 10 at each end, as shown more clearly in the cross-sectional view of FIG. 2 taken along lines A—A of FIG. 1. A 0.025 inch diameter monofilament polymer line 16 is attached from each hole 14 to its corresponding hole 14 on the other end of container 10.

Figure 3:
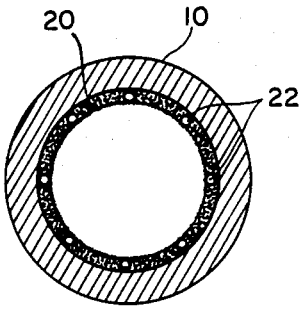

Container 10 is held at one end in a lathe chuck (not shown) and rotated at approximately 200 rpm. While rotating, a slurry of metal powder mixed into a viscous binder is slowly injected inside container 10 to cover the inside surface 18 of container 10 and lines 16. The rotational speed of container 10 is next increased to approximately 3000 rpm until the slurry levels out and seeks the level of the sleeved ends of container 10. Forced air is then introduced inside container 10 for approximately two hours to dry the rotating wick and form a green wick. Container 10 is removed from the rotator and placed into a sintering oven for approximately five to thirty minutes at 1000° C. The viscous binder will disintegrate from the heat and leave a sintered metal wick 20. The monofilament polymer lines 16 will also disintegrate and leave open arteries 22 as shown in FIG. 3.

The drilled holes 14 section and sleeved ends of container 10 are cut off to any desired length for the heat pipe and end caps fitted and welded into place. The carbon residue left by the disintegrated lines 16 is easily washed out using an ultrasonic cleaner.

In a preferred embodiment, the slurry comprises a powder of Type 255 MOND nickel metal powder (sizes about 3 to 5 microns) from International Nickel mixed into a binder comprising water, Polyox, a high molecular weight polymer of ethylene oxide available from Union Carbide Corp oration, and Methocel, a methyl cellulose binder material available from Dow Corning Corporation. A mixture of 1 gram of Methocel, 1 gram of Polyox, 100 grams of nickel powder and 110 grams of water has made a successful wet and viscous binder. Slight changes in proportions may be made to finely adjust the final viscosity of the slurry.

While the disclosed embodiment shows the arteries as being made adjacent to the inside surface of the heat pipe container, those with skill in the field of art of the invention will readily see that the lines may be supported above the inside surface so that they will not merely be covered by the slurry, but also surrounded, and that the arteries will then be completely enclosed within the final wick. Additionally, while the disclosed method includes placing or securing the lines by any means, those with skill in the field will see that the disclosed embodiment of pulling the lines taut produces extremely accurately placed arteries.

Those with skill in the art of the invention will also see that lines of different diameter may be easily substituted (a particular advantage of the use of monofilament polymer lines is the large variety of standard diameters available) and wicks may be made with different size arteries in the sam wick and with more or fewer arteries.

Those with skill in the art of the invention will further see that the disclosed method will successfully make arteries in heat pipe wicks made by other heat pipe wick making methods.

Those with skill in the art of the invention will also further see that the lines may be made of any material that can decompose at temperatures less than that required to sinter the metal particles, or less than the temperatures used to heat treat or which may otherwise be applied to wicks produced by other methods.

The disclosed method successfully demonstrates making arteries within a sintered metal heat pipe wick. Although the disclosed process is specialized, extension of its underlying methodology will find application in other areas where precisely located and formed openings are desired in fabricated structures.

It is understood that other modifications to the invention as described may be made, as might occur to one with skill in the field of this invention. Therefore, all embodiments contemplated have not been shown in complete detail and other embodiments may be developed without departing from the spirit of the invention or from the scope of the claims.

We claim:

1. A method for making arteries inside a heat pipe wick comprising the steps of:

(a) securing at least one line at a preselected position generally within a volume to be occupied by the wick;

(b) fabricating the wick so that it covers the secured line; and, (c) heating the wick to a temperature above the decomposition temperature of the line so that the line disintegrates leaving in its place an artery through the wick.

2. The method for making arteries inside a heat pipe wick according to claim 1, wherein the lines are made of a monofilament polymer.

3. A method for making a heat pipe wick, with arteries, on an inside surface of a heat pipe container, comprising the steps of:

(a) securing lines at preselected positions;

(a) providing a slurry of metal particles suspended in a viscous binder;

(b) coating at least part of the inside surface of the container with the slurry;

(c) rotating the container so that the slurry generally cover the inside surface of the container and the lines;

(d) while continuing to rotate the container, drying the slurry to form a green wick; and, (e) heat treating the green wick to yield a final composition of the heat pipe wick, wherein the heat treating includes temperatures above at least the decomposition temperature of the lines so that the lines disintegrate leaving in their place arteries through the wick.

4. The method for making a heat pipe wick according to claim 3, wherein the heat treating includes heating the green wick in a reducing gas atmosphere held above the decomposition temperature of the viscous binder and below the melting point of the metal particles to yield a sintered metal heat pipe wick.

5. The method according to claim 3, wherein the metal particles are made from a metal selected from the group consisting of nickel, copper, molydenum, aluminum and their alloys.

* * * * *

UNITED STATES PATENT AND TRADEMARK OFFICE

CERTIFICATE OF CORRECTION

PATENT NO. : 4,929,414

DATED : May 29, 1990

INVENTOR(S) : John F. Leonard et al

It is certified that error appears in the above-identified patent and that said Letters Patent is hereby corrected as shown below:

On the title page, item [57]:

ABSTRACT - The first two sentences should read

---A new method for making a heat pipe wick and arteries is disclosed. Radial holes are drilled around the circumference of the heat pipe container at its ends and monofilament polymer lines strung inside the container between corresponding holes.---

Col 2, line 36, "complicatedm," should read ---complicated,---.

Col 2, line 57, "Walls" should read ---walls---.

Col 3, line 37, "a rtery-forming" should read ---artery-forming---.

Col 4, line 20, "Corp oration," should read ---Corporation,---.

Signed and Sealed this

Nineteenth Day of May, 1992

*Attest:*

*Attesting Officer*

DOUGLAS B. COMER

*Acting Commissioner of Patents and Trademarks*